United States Patent [19]

Sargent

[11] 4,013,881

[45] Mar. 22, 1977

[54] SAFETY SIGNAL CANE

[75] Inventor: Otto E. Sargent, Mountain View, Calif.

[73] Assignee: Mary Elvera Sargent, Mountain View, Calif.

[22] Filed: May 19, 1975

[21] Appl. No.: 570,788

[52] U.S. Cl. ..... 240/6.42; 240/103 R

[51] Int. Cl.[2] ..... F21V 33/00

[58] Field of Search ..... 240/6.42, 103 R, 103 A, 240/103 B, 103 C, 105

[56] References Cited

UNITED STATES PATENTS

| | | | |
|---|---|---|---|
| 2,173,624 | 9/1939 | Dyer | 240/6.42 |
| 2,271,190 | 1/1942 | Gioimo | 240/6.42 |
| 2,362,131 | 11/1944 | Haggart, Jr. | 240/6.42 X |
| 2,435,650 | 2/1948 | Greene | 240/6.42 |
| 2,642,519 | 6/1953 | Caustin et al. | 240/6.42 |
| 3,275,815 | 9/1966 | Petroff et al. | 240/6.42 |

FOREIGN PATENTS OR APPLICATIONS

| | | | |
|---|---|---|---|
| 536,423 | 5/1941 | United Kingdom | 240/6.42 |

*Primary Examiner*—Edna M. O'Connor

[57] ABSTRACT

A walking cane having tubular shafts in its construction through which a switch means and flashing lamp means extend and on which a cover member is secured to house said flashing lamp means. The cover member at a point 8 inches upwards from the ground end of tubular cane is of translucent substance (Lucite) thereby exposing the inner Lucite tubular "string reflector" flashing light beams. The rubber safety grip at the cane's end has a central opening permitting light beams to escape in the direction in which the cane is pointed. The batteries are housed in tandem fashion at a vantage point inside the tubular cane shaft for proper balance. The cane handle portion is easily removed for replacement of batteries and light bulb. The rubber safety grip at the ground end of the cane is removable for any adjustment of the string reflector and is moisture-proof.

3 Claims, 4 Drawing Figures

SAFETY SIGNAL CANE

OBJECTIVES

It is an objective of this invention to provide a practical and useful walking cane with a safety flashing light beam emanating from the cane end section as well as a direct light beam through the cane shaft, controlled by a switch housed in the handle section for fingertip operation.

It is an object of this invention to provide sufficient light reflection from the sides of the end section to attract motorists and cycle riders for safety purposes without blinding or distracting their vision.

It is an object of this invention to provide a reflector means apart from the lamp means transmitting light beams in all directions except upwards towards the handle of the cane.

It is also an object of this invention to provide a casing means housing batteries that is moisture-proof, thereby preventing corrosion and shortages.

It is an object of this invention not to restrict the style design or capacity or color finish of exterior surfaces, to any particular pattern or form.

It is also an object of this invention to embody simple safety features without complicating the chore of adjustments or replacements and to construct a safety signal cane with sturdy materials and conventional components.

THE DRAWINGS

Figure 1:
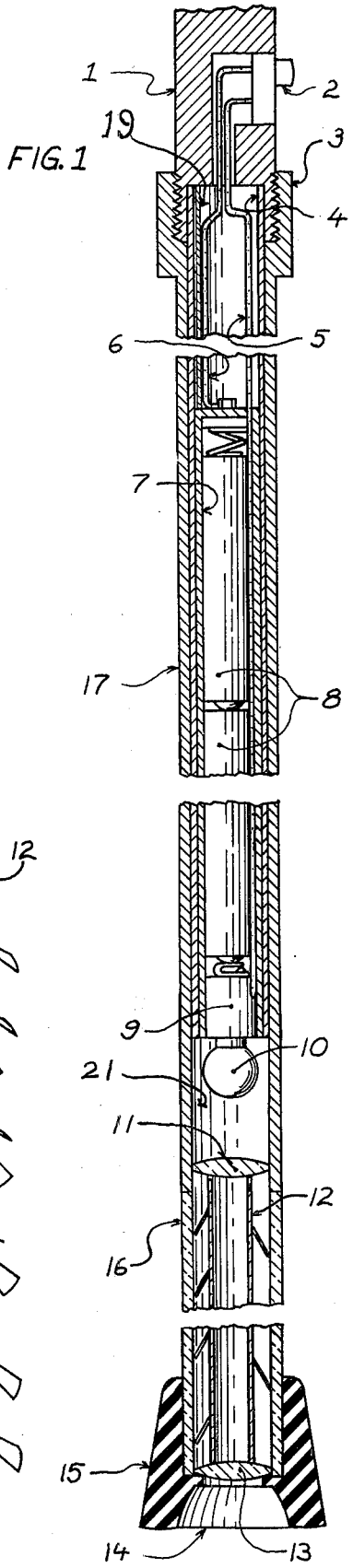
FIG. 1 is a fragmentary vertical sectional view of the cane shaft and its tubular components.

Numerical reference to the drawings of this invention is detailed in connection with explanatory notes describing the invention thus:

FIG. 1 — The handle portion 1 of the cane, constructed of wood or other suitable material, shows a section furrowed out from the end and recessed on the inner circumference surface housing an electric switch 2 and wiring (5 and 6) therefrom.

The threaded end-section of the handle portion receives a metal or plastic collar 3 also threaded and securely fastened to an outer angular tubular shaft 17 of metal or plastic material extending downward to a point 8 inches in length from the ground end where it is joined and securely glued to an outer angular tubular Lucite shaft 16, having the density and alignment of both inner and outside surfaces as the outer angular tubular shaft 17.

NOTE: Lucite tubing is chosen for its clarity and reflective qualities.

The inner angular tubular shaft 4 extending from the handle portion 1 downward to the end level of the electrical bulb 10, and socket 9 is a casing fitted inside the outer angular tubular shaft 17 to house and hole the battery casing 17 the wiring circuit 5 and 6, the light socket 9, and the light bulb 10.

While the drawing indicates the wiring traveling in a direct path to their respective terminals, it is understood that the wiring is extended in length so as to form coils in the upper well area of the inner angular tubular shaft 4. The use of said coil allows the handle portion 1 and the outer angular tubular shaft 17 to be unscrewed and separated, permitting easy access for switch 2 repair, light socket 9 removal (for replacement of batteries) and light bulb 10 replacement. The battery casing 7 is positioned inside the inner angular tubular shaft 4 so as to insure proper balance of battery weight. The battery casing 7 is held in place against the upper end of the inner angular tubular shaft 4 by a section of tubular conduit serving as a spacer 19 from the handle portion end down to the selected position of the battery casing 7.

The light or lamp socket 9 is a plug fit cylinder with the positive wire 5 securely fastened and connected to the lamp bulb element 10 and switch 2. Said wire 5 serves a dual purpose, being positioned alongside of the outside battery casing 7 it acts in the capacity of a shim or wedge against the interior surfaces of the angular tubular shaft 4 thus eliminating rattle or movements of components. The ground wire 6 is connected to the base terminal of the battery casing 7 and to the electric switch 2.

The encased batteries 8 are of the cartridge type, size AA 1.5 volts, four in number, positioned in tandem fashion in the battery casing 7. Additional batteries may be installed in battery casing if more energy output is desired, including the increase of lamp capacity 10 without modification of the inner angular tubular shaft 4.

Components 4, 5, 6, 8, 9, 10 and 19 are easily removed by unscrewing the collar band 3 from the handle portion section 1. After removing all of the components 4,5,6,8,9,10 the batteries are released by removing lamp socket 9 from battery casing 7. Lamp bulb 10 is also removable if necessary for replacement. While the drawing shows components 17, 4 and 7 positioned close to each other to avoid movement or rattle, the exterior walls of 4 and 7 components are lubricated for easy end removal at junction 3.

Figure 2:
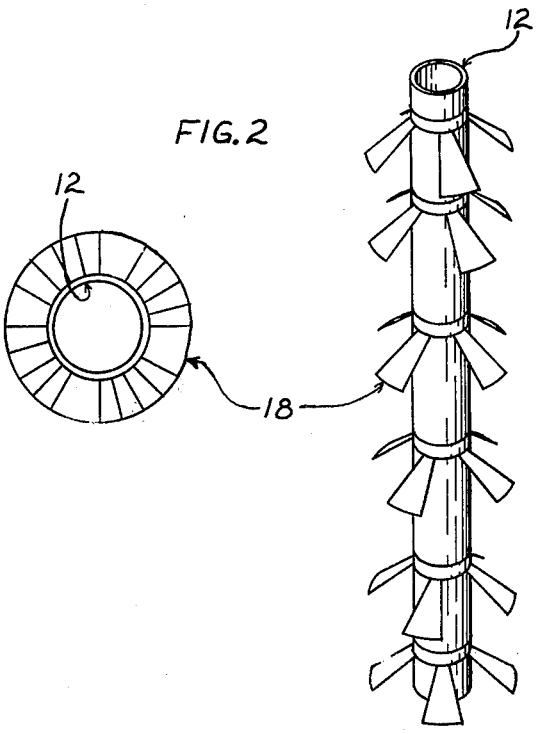
FIG. 2 is a perspective view of the tubular "string reflector" mounted with obliquely positioned fins.

The Lucite angular tubular shaft section 8 inches in length is permanently secured to the outer angular tubular shaft 17 near the ground end of the cane and comprises the light beam reflector area housing or outer angular tubular Lucite shaft 16, which contains the "string reflector" unit, FIG. 2.

FIG. 2 — shows the string reflector unit composed of a Lucite angular tubular axis type shaft ⅜ × 6-½ inch in length 12 which supports a series of units of highly polished metallic fins 18. Each unit has five fins staggered around its axis ring and is positioned at intervals along the tubular shaft 12. Each fin is obliquely slanted 18 from the shaft and each unit of fins is rotated, on the axis created by the shaft, a slight amount relative to the adjoining units to interrupt the direct light beams emanating from the lamp source 10, thereby creating the utmost efficiency in the refraction of available light beams and producing the most refulgent flashing light beams through the side walls of the Lucite angular tubular shaft 16, without blinding the motorist, cycle rider, or others, and without directing any light beams upward towards the cane handle 1 of the user.

The end view of the above described string reflector 12 and 18, depicts the unit position aspects of the fins. On each end of the Lucite angular tube 12 is a glass magnifying lens 11 13 positioned and glued in place in such manner as to ensure alignment with the central ⅜ inch angular tube 12 so as to provide equal distance between the axis type tubular shaft and the outside Lucite tube to receive the fin 18 units. The outside dimension or circumference of each lens 11 and 13 is carefully ground to plug-fit into the interior wall surface of the Lucite angular tubular shaft 16 which is held in place at a distance of one and one-half inches (1-½ in.) from the lamp bulb 10 by a thin amber colored plastic sleeve 21 and secured at the end of the angular tubular shaft 17 by a rubber safety cane grip 15 with a concave opening in the center 14 of a dimension smaller than that of the lens so as to incorporate the glass magnifying lens 13 and the end of the angular tubular shaft 17 in an airtight, moisture-proof fashion. The wall surface of the concave opening 14 is treated with a luminous paint to enhance the direct light beams emanating from the string reflector 12 area.

Figure 3:
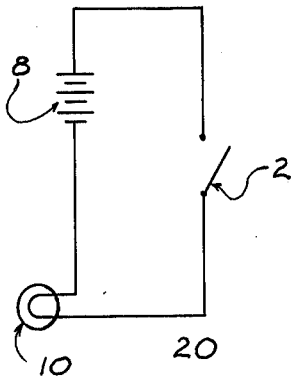
FIG. 3 is a diagram of the electrical circuit for the operation of the safety signal cane light means and reflection system.

FIG. 3 — 2 is an electrical circuit diagram showing batteries 8, switch 2 and lamp 10.

Figure 4:
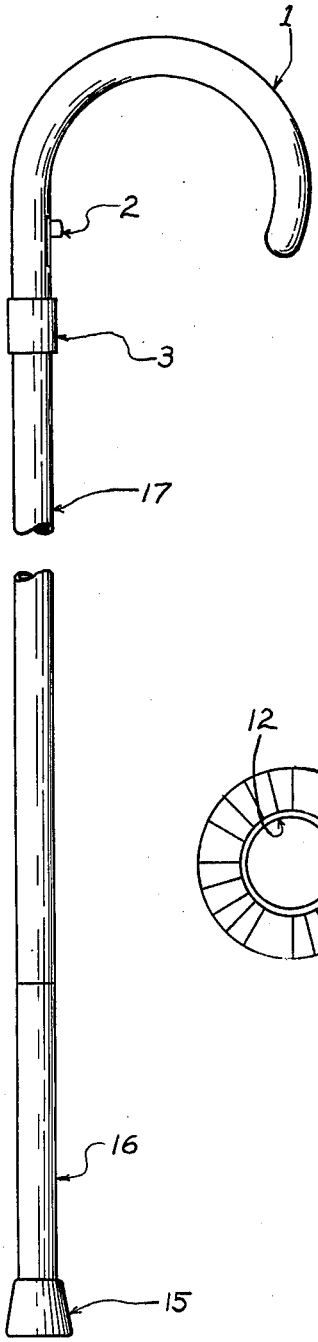
FIG. 4 is a vertical sectional view of the angular tubular cane when assembled.

FIG. 4 — shows a vertical view of the exterior of the invention, namely a Safety Signal Cane. 2 denotes the switch button. 3 shows the threaded collar function of the outer angular tubular cane shaft 17, 16 shows the Lucite angular tubular section for light emission and 15 shows a side view of the rubber safety grip, which is removable for easy access to reflector area or to remove the string reflector unit 12, 11, 13.

While the present invention has been described in detail herein, it will be apparent that the same is susceptible to variations, modifications, and alterations without departing from the spirit of my invention.

I therefore desire to avail myself of all variations, modifications, and alterations fairly coming within the scope of the appended claims.

What I claim is new and desire to protect by Letters Patent is:

1. In a tubular type cane having a shank portion, a handle portion, an angular Lucite tube, and a light source powered by an electric battery means, said light source being contained in said shank portion and manually controllable through the use of an electrical switch and coiled wire: a reflector means contained in said Lucite tube and composed of a shaft to which are obliquely appended fin-type reflectors made of highly reflective material located on said shaft so as to provide 360° of reflected light beams about said shaft, and not just a "glow," thereby providing the most refulgent multi-directional refraction of flashing light beams from the exterior surfaces of said tube without obstructing the vision of the user or others.

2. In an illuminated cane such as that claimed in claim 1, said shaft being transparent and tubular, a magnifying lens attached to each end of said shaft, through which said light beams emanating from said light source are concentrated and projected axially through said shaft and out through the ground end of the cane, thereby creating both multi-directional and, wheresoever the user points the cane, unidirectional light beams.

3. In an illuminated cane such as that claimed in claim 2, a rubber safety grip to be attached to the ground end of said cane, having a concave hole in the center through which said unidirectional light beam passes; said grip serving to secure the lens and fin-type reflector means with a moisture proof seal, yet being easily removable.

* * * * *